US005931352A

United States Patent [19]

Dirr

[11] Patent Number: 5,931,352

[45] Date of Patent: Aug. 3, 1999

[54] SNAP-FIT NON-DRIP VALVE AND METHOD FOR ASSEMBLY THEREOF

[75] Inventor: Mark S. Dirr, Park Ridge, Ill.

[73] Assignee: Knight Plastics, Inc., Evansville, Ind.

[21] Appl. No.: 08/927,345

[22] Filed: Sep. 11, 1997

[51] Int. Cl.[6] ..... B65D 37/00

[52] U.S. Cl. ..... 222/212; 222/494

[58] Field of Search ..... 222/184, 212, 222/491, 494

[56] References Cited

U.S. PATENT DOCUMENTS

| | | | |
|---|---|---|---|
| 571,708 | 11/1896 | Thompson | 137/845 |
| 1,881,929 | 10/1932 | Pottenger, Jr. . | |
| 1,897,276 | 2/1933 | Petersen | 222/496 |
| 1,977,227 | 10/1934 | Berendt | 222/494 |
| 2,540,842 | 2/1951 | Stanley et al. | 222/490 |
| 2,788,160 | 4/1957 | Hertz | 222/492 |
| 2,876,935 | 3/1959 | Lindberg | 222/145 |
| 2,912,999 | 11/1959 | Kersh | 137/843 |
| 2,913,749 | 11/1959 | Ayres | 222/494 |
| 3,067,787 | 12/1962 | Salk | 141/321 |
| 3,116,747 | 1/1964 | Cowles et al. | 137/846 |
| 3,165,242 | 1/1965 | Jackson | 222/495 |
| 3,490,658 | 1/1970 | Schwartzman | 222/494 |
| 3,545,682 | 12/1970 | Beard | 222/494 |
| 3,726,436 | 4/1973 | Despain et al. | 222/213 |
| 3,754,690 | 8/1973 | Marchant | 222/494 |
| 3,768,705 | 10/1973 | Spatz | 222/212 |
| 3,770,167 | 11/1973 | Ewald | 222/153 |
| 3,779,276 | 12/1973 | King | 137/512.4 |
| 3,794,213 | 2/1974 | Schwartzmann | 222/107 |
| 3,913,809 | 10/1975 | Nilson | 222/494 |
| 3,937,371 | 2/1976 | Del Bon | 222/494 |
| 4,132,334 | 1/1979 | Danks | 222/490 |
| 4,209,485 | 6/1980 | Greenspan | 264/242 |
| 4,375,825 | 3/1983 | Greenspan | 137/852 |
| 4,580,701 | 4/1986 | Tamaki | 222/92 |
| 4,646,945 | 3/1987 | Steiner | 222/207 |
| 4,660,747 | 4/1987 | Borg et al. | 222/213 |
| 4,728,006 | 3/1988 | Drobish et al. | 222/181 |
| 4,747,522 | 5/1988 | McIntyre | 222/213 |
| 4,782,985 | 11/1988 | Kinsley | 222/481.5 |
| 4,869,405 | 9/1989 | Rudick | 222/518 |
| 4,903,867 | 2/1990 | Mettenbrink | 222/207 |
| 4,924,899 | 5/1990 | Po | 137/232 |
| 4,938,390 | 7/1990 | Markva | 222/206 |
| 4,942,911 | 7/1990 | Herbet | 141/359 |
| 4,991,745 | 2/1991 | Brown | 222/212 |
| 5,005,737 | 4/1991 | Rohr | 222/212 |
| 5,007,545 | 4/1991 | Imbery, Jr. | 215/14 |
| 5,033,655 | 7/1991 | Brown | 222/212 |
| 5,038,957 | 8/1991 | Gross | 220/335 |
| 5,071,017 | 12/1991 | Stull | 215/260 |
| 5,115,950 | 5/1992 | Rohr | 222/490 |
| 5,125,539 | 6/1992 | Schneider | 222/144.5 |
| 5,169,030 | 12/1992 | Lewin | 222/92 |
| 5,184,760 | 2/1993 | Weinstein et al. | 222/207 |
| 5,213,236 | 5/1993 | Brown | 222/185.1 |
| 5,240,149 | 8/1993 | Schmidt et al. | 222/212 |
| 5,271,531 | 12/1993 | Rohr et al. | 222/212 |
| 5,275,309 | 1/1994 | Baron et al. | 222/129.1 |
| 5,309,961 | 5/1994 | Franke | 141/286 |
| 5,310,112 | 5/1994 | Meshberg | 222/482 |
| 5,353,968 | 10/1994 | Good, Jr. | 222/212 |
| 5,363,890 | 11/1994 | Yeung et al. | 141/364 |
| 5,377,877 | 1/1995 | Brown et al. | 222/105 |
| 5,398,853 | 3/1995 | Latham | 222/491 |
| 5,409,144 | 4/1995 | Brown | 222/185 |
| 5,431,290 | 7/1995 | Vinciguerra | 215/11.5 |
| 5,439,143 | 8/1995 | Brown et al. | 222/185.1 |
| 5,472,021 | 12/1995 | Tsao et al. | 141/1 |
| 5,492,253 | 2/1996 | Proshan | 222/547 |

FOREIGN PATENT DOCUMENTS

| | | | |
|---|---|---|---|
| 2048827 | 12/1980 | United Kingdom | 222/494 |

*Primary Examiner*—Joseph A. Kaufman
*Attorney, Agent, or Firm*—Leydig, Voit & Mayer, Ltd

[57] ABSTRACT

In a closure for a squeeze container, a first valve component is provided which includes an integrally formed membrane and central stem, and a second valve component is provided which includes a tubular dispensing spout. The first and second components are snap-assemblable so that the stem and membrane are fixed concentrically within the tubular dispensing spout so that a periphery of the inverted membrane annularly contacts a wall of the spout. This causes a radially-directed sealing bias is formed between the inverted membrane and the spout.

20 Claims, 3 Drawing Sheets

SNAP-FIT NON-DRIP VALVE AND METHOD FOR ASSEMBLY THEREOF

FIELD OF THE INVENTION

The present invention relates to a pressure-actuatable valve and a method for its manufacture. More particularly, the present invention relates to a dispensing valve suitable for use in a bottom-dispensing squeeze container.

BACKGROUND OF THE INVENTION

Various closures are available for squeeze-bottle dispensing containers. Squeeze bottles are often used for packaging soap, shampoo, hair conditioner, and other shower and bath related products. In order to improve dispensability, convenience and marketing appeal, "inverted" squeeze containers have been introduced with bottom-mounted dispensing valves. Such a container configuration has been most commonly utilized in shower and bath products.

A valve for use in inverted containers is desirably pressure-actuatable to dispense a fluid product upon squeezing of the container. After dispensing, the valve permits a "suckback," breathing-in air so that the container returns to its unsqueezed interior volume. After breathing, the valve desirably self-seals to prevent leakage from the container until squeezed again. Conventional self-sealing dispensing valves designed for this application have displayed poor or inconsistent performance. One problem, for example, is that some such valves may leak the product.

A common dispensing valve style includes a flexible slitted diaphragm provided at an opening of the container. When the bottle is squeezed, the diaphragm flexes outwardly, thereby dilating the slit to permit the fluid to discharge. Such slitted-diaphragm valves are disclosed in U.S. Pat. Nos. 4,646,945, 4,728,006, 4,991,745, 5,033,655, and 5,071,017. Other types of self-sealing dispensing valves are also known, such as those disclosed in U.S. Pat. Nos. 3,768,705, 5,125,539.

Therefore, a need exists for an improved self-sealing pressure-actuated dispensing valve which overcomes the deficiencies of known valves and which exhibits good performance. More specifically, it is an object of the invention to provide a valve for an inverted container which dispenses fluid, and then seals to effectively prevent any further passage of fluid due to gravity.

Some valves have a flexible element, such as a membrane or the above-described diaphragm, which is movable relative to other fixed elements between open and sealed positions. In order to ease manufacture, assembly and repair, it may be desirable to provided such elements as separate components, as opposed to a unitary structure. Therefore, an improved valve structure is needed which facilitates the securing together of such elements. Additionally, it is desirable to manufacture and assemble such a valve in a manner that is economical and which ensures reliable performance. Thus, a simple valve design is needed, as well as an improved method for assembling such a valve.

SUMMARY OF THE INVENTION

The present invention provides an improved valve suitable for a non-drip closure on a bottom-dispensing or "inverted" container. According to the present invention, a valve is provided which includes at least two cooperating components which snap-fit together, that is, a first component in the form of a membrane formed of a relatively soft polymeric material, which snaps into a second component formed of a more rigid polymeric material. The second component of the valve is preferably unitarily molded as a single unit with a container cap. As the user squeezes the bottle onto which the cap is assembled, the relatively soft membrane flexes to allow the contents to pass. As the pressure on the bottle is released, air sucks back past the membrane into the bottle and the membrane seals against the more rigid second component of the cap. More specifically, the first component has a circular membrane and an integrally formed stem which extends centrally from the membrane. The second component includes a cylindrical, tubular spout having an exit opening at one end and a supporting deck wall an opposite end. To provide easy assembly, the end of the stem opposite the membrane is shaped as a tapered catch, and a recess in the deck wall cooperatively receives the tapered catch in an engagement which resists removal. When stem is engaged in the deck wall, the stem and membrane are held concentrically within the spout so that a periphery of the membrane is in a radially-outward sealing bias against the interior of the spout.

When the first and second components are assembled, the membrane is resiliently held in a concave shape to cup away from the stem and toward an exit opening of the spout. The membrane may be formed to naturally have such a general shape. Alternatively, the membrane may be formed to be naturally concave toward the stem; the membrane may then be elastically inverted or deflected inside-out so that its direction of concavity is reversed in the assembled state.

The valve advantageously provides improved squeeze container performance. When mounted on the bottom of a squeeze container, the valve dispenses fluid upon squeeze-pressurization of the container because the membrane flexes to permit fluid to pass through the spout. When the container is relaxed, the membrane permits a "suckback" of air into the container and then resumes its sealable contact with the spout.

The present invention also provides an improved method for assembling such a valve. The method includes axially inserting the first component stem-first into the spout of and second component to cause the snap-fit engagement of the tapered catch member into the recess of the deck wall of the second component.

It will thus be appreciated that the present invention provides an improved valve for bottom-mounted dispensing from a container. The valve reliably dispenses fluid from an inverted container and then reseals to prevent or deter leakage of fluid. Thus, the valve is simple in design, yet provides an improved biasing seal to prevent leakage.

The present invention also provides an improved method for assembling a valve. The inventive method permits a convenient snap-fit assembly of valve components.

Other features and advantages of the present invention are described in, and will be apparent from, the disclosure herein.

DETAILED DESCRIPTION OF THE PREFERRED EMBODIMENTS

Figure 1:
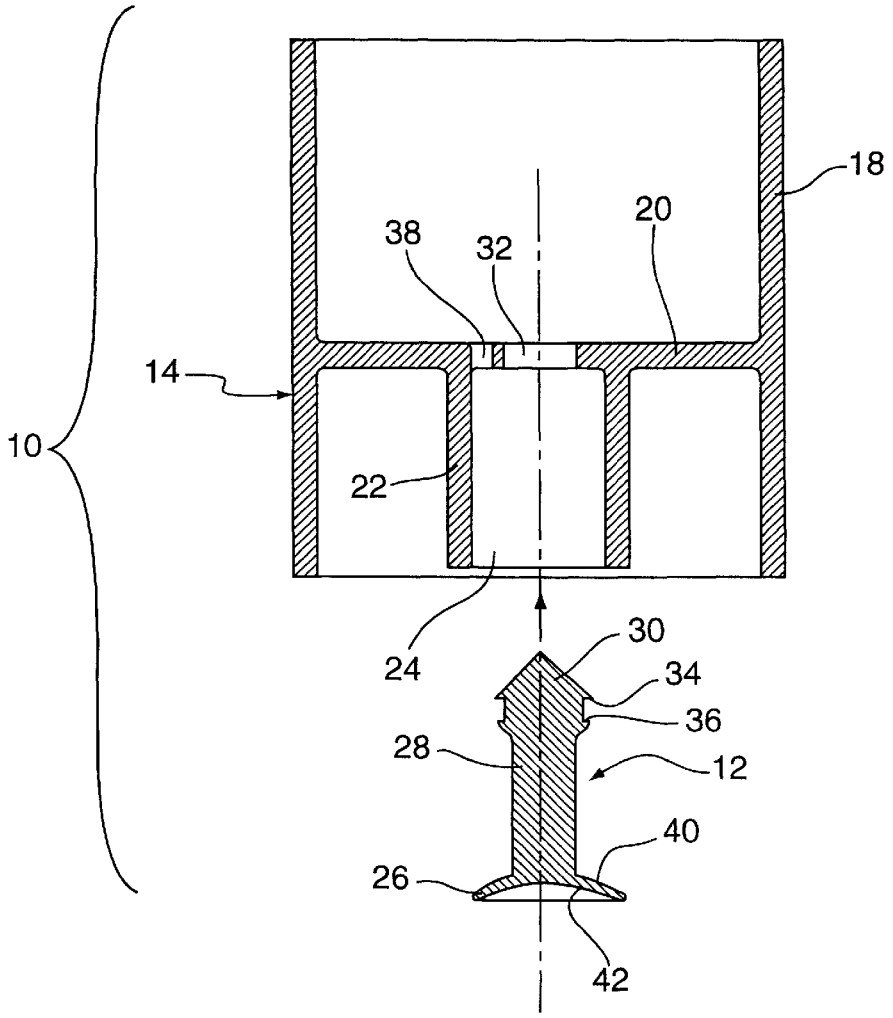
FIG. 1 is an exploded side sectional view of a valve constructed in accordance with teachings of the invention.
Figure 2:
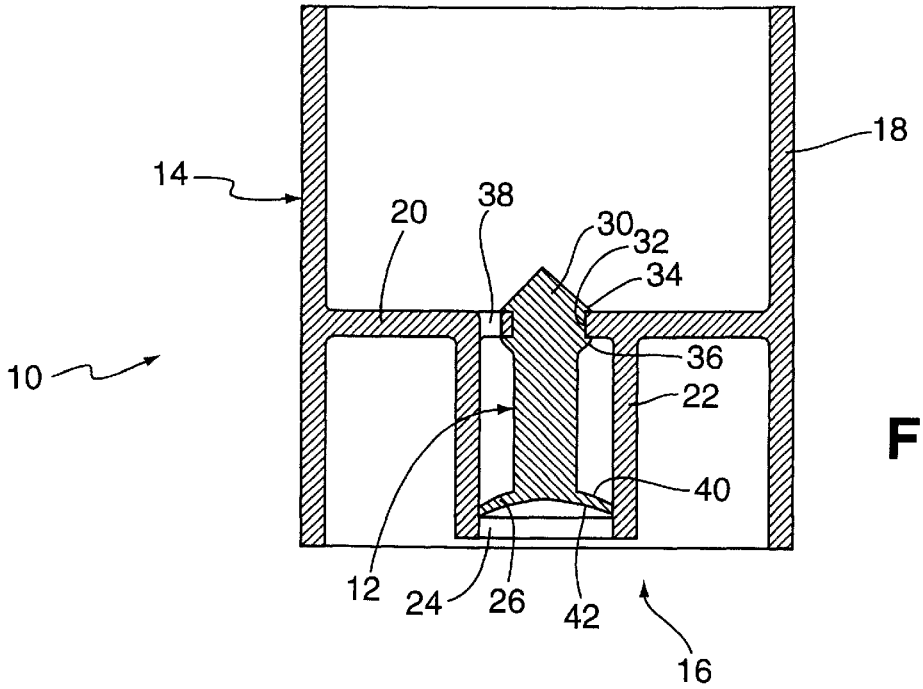
FIG. 2 is a sectional side view of the valve of FIG. 1 in an assembled condition, wherein the membrane is elastically deformed in a radially outward bias against the spout.

Now referring to the Figures, wherein like numerals designate like parts, there is shown in FIGS. 1 and 2 a cap 10 for attachment to the bottom of a squeeze container (not shown). The cap 10 includes a first component 12 and a second component 14 which are assembled together to form a valve 16. The second component 14 has a mounting wall 18 for attaching the cap 10 to the complementarily shaped bottom of the squeeze container by any appropriate means (e.g., threads, etc.), and a deck 20 for generally closing the internal cavity of the bottle. A generally cylindrical spout 22 extends downwardly from the deck 20, terminating at an exit opening 24. The valve 16 is operable to dispense fluid from the container through the deck 20 and spout 22.

According to the invention, the first component is securable to the second component in a snap-fit manner, forming the valve, these components coacting to seal and dispense fluid. At least the first component 12 is made of a moldable elastomeric material. The entire cap 10 could be made of the same material, but the two-piece design advantageously permits a preferred embodiment wherein the membrane-forming first component is made of a material which is softer and more flexible than the spout-forming second component. Such a structure provides easy dispensing but reliable sealing.

Preferably, the material for the second component is polypropylene, in a form known to those skilled in the art as a standard closure grade polypropylene. The first component is preferably made of a softer, rubber-like elastomeric material, including appropriate macromolecular materials that return rapidly to the approximate initial shape after deformation and release. Such materials includes flexible, moldable thermoplastics, such as flexible types of polypropylene, as well as other appropriate thermoplastic or rubber materials, for instance, silicon rubber, styrene butadiene rubber, ethylene propylene rubber, EPDM rubber, polybutadiene rubber, polyisoprene rubber, and other synthetic or naturally occurring rubber materials.

The first component includes a membrane having a footprint which is complementary to the inner surface of the generally cylindrical spout 22. Accordingly, when the first component is assembled within the second component, a peripheral edge of the membrane is biased in an advantageous sealing contact against the interior surface of the spout.

More particularly, FIGS. 1 and 2 illustrate the cap 10 having a valve 16 constructed in accordance with the invention, shown in unassembled and assembled states, respectively. The first component 12 includes a membrane 26 having a generally circular shape or footprint. A stem 28 extends centrally away from and is integrally formed with the membrane 26.

In order to couple the first component to the second component, the opposite end of the stem 28 is provided with a non-reentrant shape which is assembled by inserting the non-reentrant shape into a hole or recess 32 within the deck 20. Preferably, the catch member 30 is ramped or tapered to insert easily into the hole or recess 32 within the deck 20. To resist being pulled outwardly from the recess 32, the tapered catch member 30 forms an undercut shoulder 34 which resides against a side of the deck 20 opposite the spout 22. To maintain the first component 12 in the desired position once it is assembled into the hole 32, a stop shoulder 36 extends around the stem 28 at a distance from the shoulder 34 which generally corresponds to the thickness of the deck 20. In this way, the shoulder 36 securely resides against the lower surface of the deck 20, that is the same side of the deck 20 as the spout 22 when assembled as shown in FIG. 2, while the shoulder 34 resides against the opposite, surface of the deck 20. It will thus be appreciated that the stop shoulder 36 limits the insertion distance of the stem 28 through the recess 32 so that the shoulders 34 and 36 together securely hold the stem 28 in a desired position within the recess 32.

In the embodiment shown in FIG. 1, the membrane 26 is circular and molded from an elastomer which is cured into a generally concave natural shape which cups in the direction of away from the stem 28. In its natural shape, the membrane 26 preferably has a width marginally greater than an inner diameter of the spout 22. Therefore, in an assembled condition wherein the membrane 26 held within the spout 22, the membrane 26 may be slightly elastically deformed so that a peripheral edge of the membrane 26 is biased in sealing contact radially-outwardly against the spout 22. The membrane 26 and spout 22 are selected with relative dimensions to optimize this sealing contact. As will be appreciated, this radially-outward contact between the membrane 26 and the spout 22 provides effective sealing to prevent leakage, yet permits the passage of fluid around the membrane 26 when the container is squeezed.

Referring still to FIGS. 1 and 2, for permitting fluid communication from the interior of the bottle into the interior of the spout 22, the deck 20 has one or more orifice 38 disposed therein. The spout 22 extends in a direction away from the deck 20, forming a fluid channel which opens at the exit opening 24. The membrane 26 has an inner face 40 generally facing the deck 20 and an opposite outer face 42 generally facing the exit opening 24.

In use, the valve 16 may be mounted to a bottom of a squeeze-type container (not shown) for dispensing a fluid product, such as shampoo, soap, etc. Normally, the fluid passes from the container through the orifices, but the membrane prevents the fluid from exiting the spout because of the resilient sealing contact. The valve thereby facilitates drip-free fluid storage within the container. However, when the container is squeezed, the fluid is pressurized, forcing a dispensing flow of the fluid around the resilient membrane 26. More specifically, increased pressure by the fluid against inner face 40 of the membrane causes the membrane 26 to resiliently deflect toward the exit opening 24 of the spout 22. This deflection causes a separation of the peripheral edge of the membrane 26 from an interior surface of the spout 22, permitting the fluid to flow through the exit opening 24 of the spout 22.

Desirably, the valve 16 is designed to permit a "suckback" or breathing of air into the container after dispensing so that the container can return to its original volume. By selecting appropriate dimensions for the membrane 26 and spout 22, this suckback can occur without flipping the membrane 26 from its inverted shape.

Figure 3:
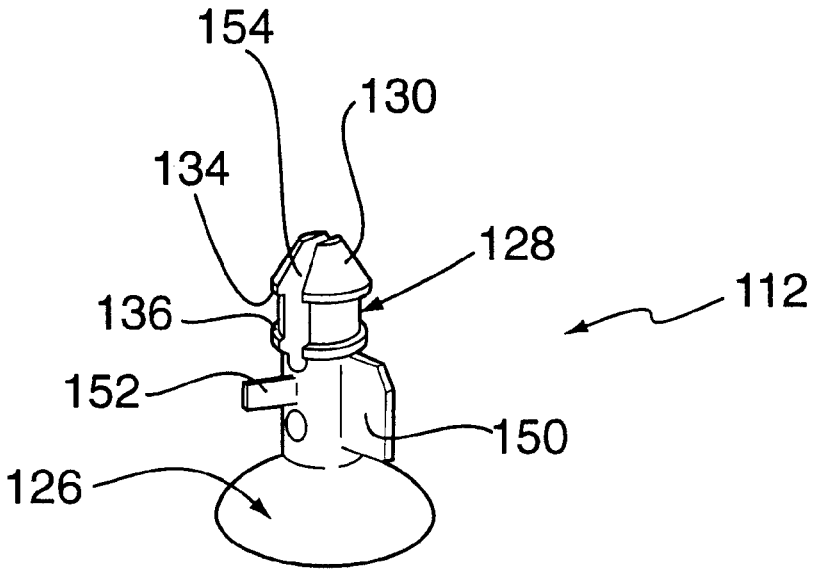
FIG. 3 is a perspective view of a preferred embodiment of a first component constructed in accordance with teachings of the invention.
Figure 4:
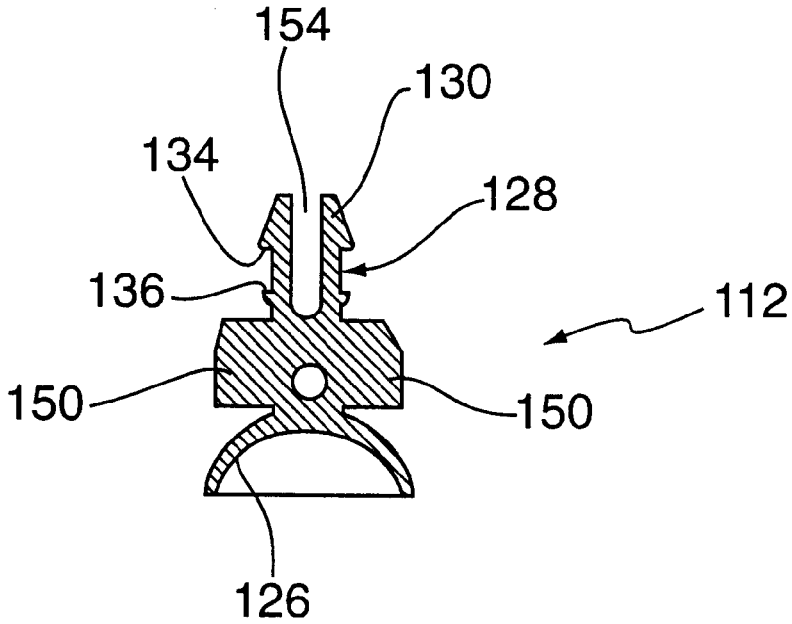
FIG. 4 is a side sectional view of the first component illustrated in FIG. 3.

A first member 112 according to the currently preferred embodiment is illustrated in FIGS. 3 and 4. The first member 112 has a membrane 126 formed with a stem 128, wherein the membrane 126 has a naturally concave shape cupping away from the stem 128. The stem 128 has a ramped catch member 130 with an undercut shoulder 134 to retain the first component 112 within the recess 32 (FIG. 1).

A stop shoulder 136 also extends from the stem 128 to provide an insertion limit. In order to hold the stem 128 centrally within the spout 22, the first component 112 shown in FIGS. 3 and 4 also includes one or more wings or projections pairs of wings or projections 150, 152 which project radially from the stem 128. The wings 150 are generally aligned parallel to the stem 128 preferably to permit the passage of fluid through the spout 22. In the embodiment illustrated, two pairs of wings 150, 152 are provided. The pairs of wings 150, 152 are oriented generally perpendicular one another, one pair of wings 152 being smaller than the other. It will be appreciated the wings may be of alternate sizes, shapes or locations from those illustrated.

To facilitate insertion of the first component 112 into the recess, the stem 128 is formed with a slot 154 which bisects the catch member 130. It will thus be appreciated that the catch member 130 resiliently flexes inwardly to allow the snap-fit insertion of the stem 128.

Figure 5:
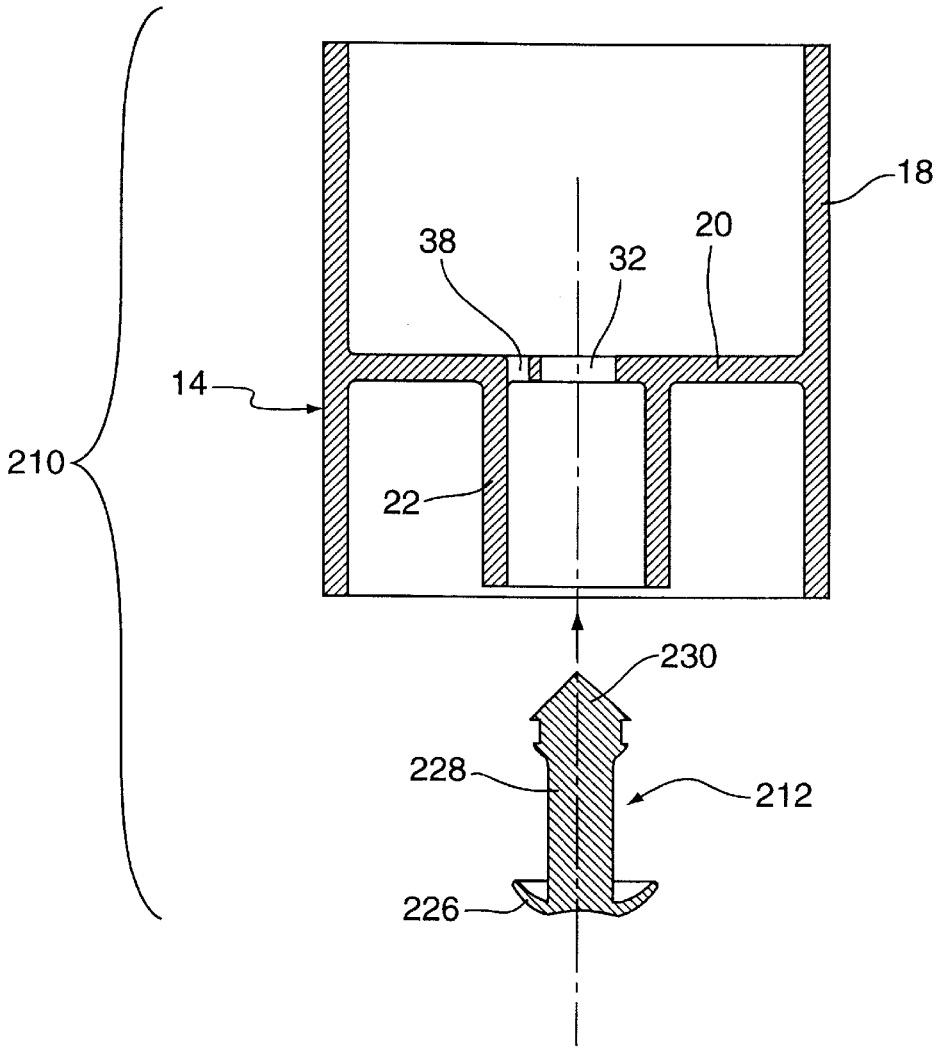
FIG. 5 is an exploded side sectional view of an alternative valve embodiment of the invention including a first component having a membrane with a natural or ascured shape which is concave as viewed from the stem.
Figure 6:
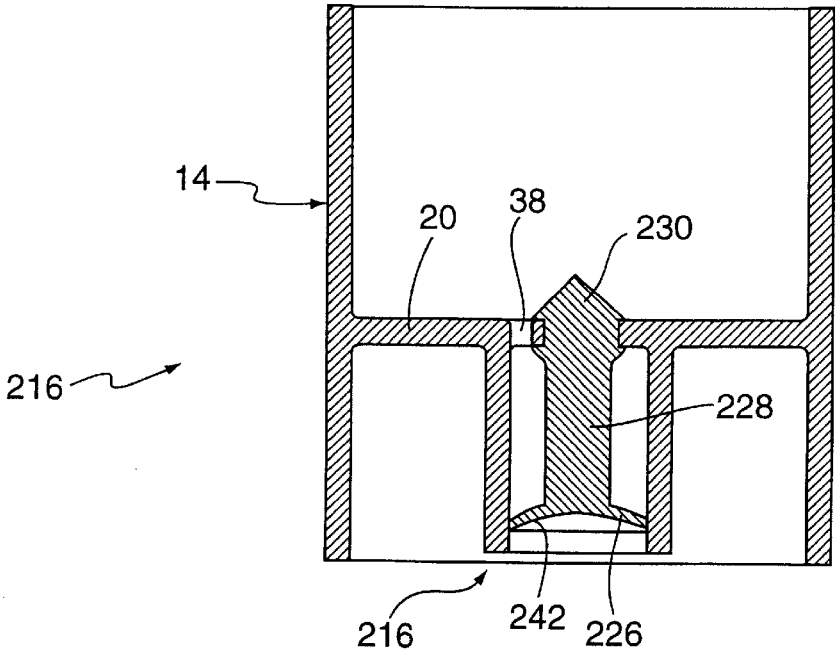
FIG. 6 is a sectional side view of the valve of FIG. 5 in an assembled condition, wherein the membrane is elastically deformed to a shape which is concave away from the stem, forming an outward radial bias against the spout.

A third embodiment of the invention is illustrated in FIGS. 5 and 6, which provides enhanced sealing bias between the membrane and the spout, cap 210 includes a valve 216 with a first component 212. The first component 212 has a membrane 226 with a natural or "as molded" shape such that the inner face of the membrane 226 curves toward stem 228 in a concave manner, in contrast to the membrane 26 of FIG. 1, which is naturally shaped to curve away from the associated stem 28. The first component 212 has a stem 228 similar to the stem 18 of the previously described embodiment in connection with FIGS. 1 and 2, having a tapered catch member 230 operable for snap-fit securing into the recess 32 of the second component 14. In the embodiment of FIG. 5, however, the membrane 226 is inverted, either prior to or upon assembly of first component 212 with the second component 14, that is, the membrane 226 is elastically deformed to a shape opposite to that of its relaxed state. Thereby, the membrane 226 is operably positioned in an inverted manner as illustrated in FIG. 6. In the operable inverted position shown in FIG. 6, an inner face 240 of the membrane 226 is no longer concave. Instead, the membrane 226 is flexed toward the exit opening of the spout so that an outer face 242 of the membrane is concave. Because the membrane 226 is made of an elastomeric material, it is resiliently urged toward the natural position of FIG. 5 so that a peripheral edge of the membrane 226 is biased in a radially outward sealing contact against the spout 22.

The diameters of the membrane 226 and spout 22 are selected with relative dimensions to optimize this sealing contact. A valve having a reversibly deformed concave membrane also disclosed in copending companion application U.S. Ser. No. 08/927,845 (Filed Sep. 11, 1997, entitled "Non-Drip Valve for an Inverted Container and Method for Making Same," by the same applicant and assigned to the assignee of this application, Attorney Docket No. 74754), incorporated herein by reference.

In order to prevent leakage during shipping, display and storage, a secure snap-fit, flip-top secondary closure (not shown) may be provided is hingeably coupled to cover the valve 16, 216. The secondary closure may be integrally formed with the cap and hingably secured thereto via a living hinge by conventional methods. Additionally, the cap may be formed with a skirt that acts as a sure-footed container bottom on which the container can stand in an upright "inverted" position.

While the invention is described herein with reference to certain preferred embodiments, there is no intent to limit it to those embodiments. To the contrary, various alternatives, equivalents, changes and modifications to the described embodiments will be apparent to those skilled in the art, and such changes and modifications may be made without departing from the spirit and scope of the invention. For example, those skilled in the art will recognize that performance of the valve will be influenced by various factors such as viscosity of the fluid product being dispensed, container pressure, diameter of the dispensing channel, flexibility of the elastomeric material, etc. Accordingly, the specific valve design may vary as needed from application to application, and the various valve dimensions and materials may be appropriately selected to suit a particular need. Therefore, the appended claims are intended to cover all such alternatives, equivalents, changes and modifications.

What is claimed is:

1. A pressure-actuatable valve for a squeeze container, the valve comprising at least first and second components which cooperatively snap-fit together;

the first valve component including a circular elastic membrane and a stem having an end integrally fixed centrally to the membrane and an opposite end forming a non-reentrant member; and the second valve component having a deck wall and a generally cylindrical spout wall extending from the deck wall forming a spout interior cavity, the deck wall having at least one opening cooperating with the spout interior cavity, the deck wall further having a recess shaped to cooperatively receive and retain the non-reentrant member in an assembled state, wherein the stem is disposed within the recess and the membrane is held concentrically within the spout so that the an outer periphery of the membrane biases radially-outwardly against an interior surface of the spout.

2. The valve according to claim 1, wherein the membrane of the first component is concave, being shaped to cup away from said stem.

3. The valve according to claim 1, wherein the membrane has an oppositely-directed inner face and outer face, and the membrane has a natural shape such that the outer face is convex, but in the assembled state, the membrane is elastically inverted such that the outer face is concave.

4. The valve according to claim 1, wherein said spout wall has an inner diameter smaller than a diameter of said membrane.

5. The valve according to claim 1, wherein the first component is made of a more flexible material than said second component.

6. The valve according to claim 1, wherein said membrane includes at least one radially-extending recess in the inner face.

7. The valve according to claim 1, wherein the non-reentrant member includes a pair of shoulders which reside against opposite surfaces of the deck to retain the stem relative to the recess.

8. A cap for an inverted container, the cap having a valve comprising:

a first component including a membrane with oppositely-directed inner and outer faces, and a stem centrally extending from said inner face of said membrane and forming a non-reentrant member; and a second component including a tubular spout forming a spout interior cavity with an exit opening at one end thereof and a deck wall extending across said spout at an opposite end thereof, the deck wall further having at least one opening in communication with the interior cavity and a recess; and wherein the non-reentrant member of the stem is securable in a snap-fit manner within the recess of the deck wall so that the membrane is held concentrically positioned within the interior of the tubular spout so that the outer face of the membrane generally faces the exit opening.

9. The cap according to claim 8, wherein the membrane has a naturally concave shape as viewed from the outer face.

10. The cap according to claim 8, wherein the membrane has a natural shape which is concave toward the inner face, but when said stem is snap-fit into said deck wall, the membrane is deflected convex, causing a peripheral edge of the membrane to reside in a radially-outward annular contact against the spout wall.

11. A cap according to claim 8, wherein said interior of said tubular spout has a diameter smaller than a diameter of said membrane when said membrane is not positioned in said spout.

12. A cap according to claim 8, wherein the first component and second component have respectively different flexibilities.

13. A cap according to claim 8, wherein the non-reentrant member includes a pair of shoulders which reside against opposite sides of the deck wall to retain the stem relative to the recess.

14. A squeeze container having a pressure-actuatable valve, the valve comprising at least first and second components which cooperatively snap-fit together; the first valve component including an elastic membrane and a stem having an end integrally fixed generally centrally to the membrane and an opposite end forming a non-reentrant member; and the second valve component having a deck wall and a generally cylindrical spout wall extending from the deck wall forming a spout interior cavity, the deck wall having at least one opening cooperating with the spout interior cavity, the deck wall further having a recess shaped to cooperatively receive and retain the non-reentrant member in an assembled state, wherein the stem is disposed within the recess and the membrane is held concentrically within the spout so that the an outer periphery of the membrane biases radially-outwardly against an interior surface of the spout.

15. The container according to claim 14, wherein the membrane of the first component is concave, being shaped to cup away from said stem.

16. The container according to claim 14, wherein the membrane has an oppositely-directed inner face and outer face, and the membrane has a natural shape such that the outer face is convex, but in the assembled state, the membrane is elastically inverted such that the outer face is concave.

17. The container according to claim 14, wherein said spout wall has an inner diameter smaller than a diameter of said membrane.

18. The valve according to claim 14, wherein the first component is made of a more flexible material than said second component.

19. The valve according to claim 14, wherein said membrane includes at least one radially-extending recess in the inner face.

20. The valve according to claim 14, wherein the non-reentrant member includes a pair of shoulders which reside against opposite surfaces of the deck to retain the stem relative to the recess.

* * * * *